US007044901B2

(12) United States Patent
Weir

(10) Patent No.: US 7,044,901 B2
(45) Date of Patent: May 16, 2006

(54) EXERCISE APPARATUS

(75) Inventor: Ross J Weir, Norwich (GB)

(73) Assignee: Progressive Sports Technologies Limited (GB)

( * ) Notice: Subject to any disclaimer, the term of this patent is extended or adjusted under 35 U.S.C. 154(b) by 0 days.

(21) Appl. No.: 10/275,601

(22) PCT Filed: May 4, 2001

(86) PCT No.: PCT/GB01/01959

§ 371 (c)(1),
(2), (4) Date: Nov. 6, 2002

(87) PCT Pub. No.: WO01/85265

PCT Pub. Date: Nov. 15, 2001

(65) Prior Publication Data

US 2003/0109364 A1 Jun. 12, 2003

(30) Foreign Application Priority Data

May 9, 2000 (GB) ..... 0011050.2

(51) Int. Cl.
*A63B 26/00* (2006.01)

(52) U.S. Cl. ..... 482/142; 482/907; 482/91

(58) Field of Classification Search ..... 482/142, 482/148, 23
See application file for complete search history.

(56) References Cited

U.S. PATENT DOCUMENTS

| | | | | |
|---|---|---|---|---|
| 4,441,221 | A * | 4/1984 | Enste et al. | 5/657 |
| 4,752,067 | A * | 6/1988 | Colonello | 482/140 |
| 4,802,249 | A * | 2/1989 | Bills | 5/420 |
| 5,207,432 | A * | 5/1993 | Miller | 473/465 |
| 6,551,225 | B1 * | 4/2003 | Romero | 482/146 |
| 2004/0002411 | A1 * | 1/2004 | Jackson | 482/121 |

* cited by examiner

*Primary Examiner*—Gregory L. Huson
*Assistant Examiner*—L. Amerson
(74) *Attorney, Agent, or Firm*—Renner, Kenner, Greive, Bobak, Taylor & Weber

(57) ABSTRACT

A kit for assembly of exercise apparatus (1) comprising a first major component (2) and a second minor component (3) each with engagement means (22–25) complementary to those on the other and detachably interengagable with each other in alternative mutual orientation of those components (2, 3) so that the assemblage can be arranged and rearranged at will be assume alternative bench, chair or incline configurations.

19 Claims, 3 Drawing Sheets

2
3
4
5
6
7
8
9
10
11
12
13
14
15
16
17
18
19
20
21
22
23
24
25
30
31
a
α
β
θ
φ

EXERCISE APPARATUS

BACKGROUND OF THE INVENTION

This invention relates to exercise apparatus, and more specifically, to such apparatus which may be arranged into multiple configurations, thus allowing a wide variety of exercises to be performed thereon.

Physical fitness, or lack of it, is a consideration to which an ever-increasing number of people are paying attention. A "work-out" in the gym is an activity engaged in by many, whether for the purposes of leisure and keeping-fit, or for serious training by sports-men and -women.

Most public or commercial gymnasiums contain a wide variety of equipment designed for anaerobic, or muscle-building exercises. These range from simple weights or "dumb-bells" to sophisticated heavy-duty equipment such as plate-loaded resistance machines, and so-called "multi-gyms". Each piece of equipment generally has a schedule of exercises associated with it, designed to increase the strength of a particular target muscle or group of muscles.

A wide range of home gymnasium equipment is also available, much of it similar to that found in a commercial gymnasium. Many home gym systems offer a combination of a number of devices and associated exercise schedules in order to provide an extensive work-out in the home.

Whilst these systems appear adequate for their intended purpose, they do have their disadvantages. In the commercial gym, the use of each piece of equipment for only a limited range of exercises necessitates the employment of many different types of apparatus in order to achieve a full work-out for each part of the body which it is desired to exercise. This has the obvious drawback of increased expense in paying for many pieces of heavy-duty and often very expensive equipment. In addition, there is the consideration of the space taken up by such machinery, and during busy periods, the inconvenience of having to employ rotation schedules in order that each customer is able to use each piece of equipment.

As noted above, many home gym systems attempt to overcome these problems by providing a combination of several pieces of equipment in one. However, these kinds of apparatus tend to be extremely cumbersome, particularly where re-arrangement of the apparatus is necessary in order to move from one exercise schedule to another. Such operations may require the use of tools to dismantle and re-assemble the apparatus, which is not only awkward and inconvenient, but often unnecessarily complicated and time-consuming, and may give rise to safety concerns if the apparatus is not correctly re-assembled by the user.

The use of many known home fitness systems also involve unnecessarily large stresses being exerted on certain parts of the equipment. For example, inclined exercise platforms are often provided with a facility whereby the angle of the incline may be varied through a number of pre-determined angles within a range. This is often achieved by rotating the platform around one end thereof, and securing it at the desired angle of incline by means of a steel pin inserted through a hole in the supporting framework. During use of the equipment, the stresses exerted on the pin can become extremely large, particularly where the user is using weights in combination with their exercise schedule. This is a cause for concern, both for the safety of the user, and the lifetime of the equipment.

There is therefore a need for a simple, lightweight yet durable construction of exercise apparatus which will be capable of being used for a comprehensive series of exercise schedules, and yet be quickly, easily, and safely manipulated between the different configurations necessary for such exercise schedules. These objectives are now attained by means of the present invention. It is envisaged that exercise apparatus according to the present invention will be used both by individuals for home exercise and in exercise classes in gymnasiums.

SUMMARY OF THE INVENTION

The principle on which the present invention is based, is the construction of a single exercise station, comprised of components in the form of simple geometric shapes which co-operate with one another in a variety of orientations, thus allowing the user to switch with the minimum amount of effort, between various known configurations of exercise apparatus. Many of the most widely used and established anaerobic exercise schedules use basic stationary apparatus in the form of "bench", "chair" or "incline" configurations, and the present invention will be described herein with particular reference to these forms of apparatus, though it is envisaged that the invention may be adapted to encompass other configurations.

The term "bench" is used herein to refer to exercise apparatus comprising a lateral exercise platform of sufficient length and width so as to accommodate the head and body of the user when lying flat thereon, but with his or her legs extending beyond the edge of the platform. The platform should be of sufficient elevation above the ground such that the user when lying in this rest position can with knees bent, place his or her feet flat against the floor. From this rest position the user can then perform a range of exercises with or without simple weights such as dumb-bells, or bar-bells. Such exercises may include bench presses, shoulder presses, sit-ups, etc.

The term "chair" is used herein to refer to an exercise apparatus comprising a seat portion of sufficient elevation above the ground so as to allow the user to sit thereon and with knees bent place his or her feet flat against the floor, and a back portion of sufficient length so as to support the user's back and neck when sitting thereon. From this rest position the user can again perform a range of exercises with or without simple weights such as dumb-bells or bar-bells. Exercises in this position are likely to concentrate on strengthening areas of the upper body such as pectorals, biceps, shoulders etc.

The term "incline" is used herein to refer to an exercise apparatus similar to the bench configuration described above but with the platform inclined at a pre-determined angle. Such an apparatus is likely to be used for exercises such as sit-ups etc. to improve the strength of lower body or abdominal muscles, the angle of the incline serving to provide increased resistance against gravity, and the variation of the working angle from the horizontal offering a more comprehensive overall strength development programme for the user.

According to the present invention, there is provided exercise apparatus in the form of a kit of parts, whether assembled or not, which comprises at least a first major component and a second minor component, each provided with engagement means complementary to those on the other and detachably interengageable therewith in alternative mutual orientations of the components so that the resultant assemblage can be arranged and rearranged at will to assume at least two alternative configurations selected from a range comprising bench, chair and incline configurations.

In a currently preferred embodiment of the invention, the major and minor components are each substantially symmetrical about a shared, normally-vertical plane of symmetry, which also accommodates the user's body-axis when the apparatus is assembled in the bench, chair or incline configurations. The complementary engagement means on both the major component and the minor component are disposed and are mutually engageable and disengageable normal to this plane of symmetry, when arranging the apparatus so as to form the bench or chair configurations.

The major component is preferably provided with engagement means in at least three alternative sites thereon, each of them interengageable at will with complementary engagement means provided at a site on the minor component, said sites on the major component being so located thereon as to configure the resultant assemblage respectively as bench, chair or incline.

So as to facilitate the inter-engagement of the major and minor components in their various alternative mutual orientations, it is currently preferred that, in overall outline in the shared normally-vertical plane of symmetry that accommodates the user's body axis, the major and minor components are each generally wedge-shaped, with the opposed wedge-forming sides thereof subtending the same angle $\theta$ in each component. When assembled with one of the wedge-forming faces of each component in abutting contact with one of the wedge-forming faces of the other, then the respectively opposed faces of both components are parallel with each other, and thus the assemblage is arranged in its bench configuration.

Above all, it is preferred that, in overall outline in the shared normally-vertical plane of symmetry that accommodates the user's body-axis, the major component is a generally wedge-shaped irregular pentagon, having major and minor wedge-forming sides, and the minor component is a generally wedge-shaped irregular tetragon, having first and second wedge-forming faces, each of said components having two opposed non-parallel sides subtending the same angle in each component and each having two other opposed generally parallel sides. The pentagon also has a fifth side intersecting with the minor wedge-forming side at one end thereof, and with the major end-face bearing side of the two generally parallel sides at its other end.

References herein to wedge-forming faces, end-faces, and the fifth face of the pentagon, should be construed accordingly as referring to the respective faces of the three-dimensional major and minor components which correspond to the above-described sides of the two-dimensional irregular pentagon and irregular tetragon, when the major and minor components are viewed in cross-section in the shared normally-vertical plane of symmetry.

When assembled with the major end-faces of both components side-by-side in the same horizontal plane and with one of the wedge-forming faces of the tetragon in abutting facial contact with the fifth face of the pentagon then the assemblage is arranged so as to assume its chair configuration. The minor end-face of the tetragon lies in an horizontal plane to serve as the seat-portion of said chair, and the minor wedge-forming face of the pentagon reclines therefrom to serve as the back-portion of said chair.

The major and minor wedge-forming faces of the major component constitute, respectively, the exercise platform when the apparatus is assembled in the bench or incline configuration, and the back support when the apparatus is assembled in the chair configuration.

When in the bench configuration, the major wedge-forming face will lie in a horizontal plane, so as to bear the exercise platform of the bench. The cross-sectional profile of the entire arrangement when in this configuration, in the shared vertical plane of symmetry that accommodates the user's body-axis, will be substantially that of a parallelogram.

The acute angle, $\theta$ subtended by the wedge-forming opposed non-parallel faces of the major component is equal to that subtended by the wedge-forming opposed non-parallel faces of the minor component; the acute angle, $\theta$ between the major wedge-forming face of the major component and a perpendicular from the major end-face thereof is equal to the acute angle between the second wedge-forming face of the minor component and a perpendicular from the major end-face thereof; the acute angle, p between the minor wedge-forming face of the major component and a perpendicular from the major end-face thereof is equal to the acute angle between the first wedge-forming face of the minor component and a perpendicular from the major end-face thereof; and $\alpha+\beta=\theta$. The back-portion of said chair therefore reclines at an acute angle from the vertical which is equal to $\beta$. Preferably, $\alpha$ and $\beta$ will be substantially equal to one another, such that $\alpha=\beta=\theta/2$.

In a currently preferred embodiment of the invention, the major component is further provided with a cut-out section in the corner thereof between its major end-face and the fifth face thereof, which cut-out section comprises an internal face intersecting the fifth face, being parallel to the major end-face of the major component, and an internal face intersecting said major end-face, being parallel with the major wedge-forming face of said major component. The dimensions of the cut-out are complementary with those of the minor component, such that when the minor end of the minor component is mated therewith, its second wedge-forming face is co-planar with the minor wedge-forming face of the major component, so that when thus assembled the resultant assemblage assumes its incline configuration.

When assembled thus, in its incline configuration, the minor wedge-forming face of the major component rests on the ground, as does the second wedge-forming face of the minor component. The major wedge-forming face then bears the exercise platform, which is inclined at an angle $\theta$, from the horizontal.

It is desirable that the major component should be provided with side-pods around the cut-out section, said side-pods comprising a side parallel to and co-planar with the fifth side of the pentagon, and a side parallel to and co-planar with the major end-face of the major component. The side-pods are displaced outwards from the plane of the pentagon so as to constitute extensions of the fifth face thereof and the major end-face, but still allowing access to the complementary internal faces within said cut-out.

The side pods serve to stabilise the apparatus when in the bench and chair configurations, yet allow the minor component to be inserted into the cut-out section, in the shared normally-vertical plane of symmetry, via the corner of the major component between the fifth face and the major end-face thereof.

In the currently preferred embodiment, the major component is provided with engagement means in three sites thereon, said sites comprising:

- a site located in the minor wedge-forming face, disposed substantially towards the minor end thereof, which site accommodates the engagement means of the minor component so as to form the bench configuration;
- a site located in the fifth face of the pentagon, which site accommodates the engagement means of the minor component so as to form the chair configuration; and a site located within the cut-out section, in the internal face intersecting the major end-face, being parallel with the major wedge-forming face, which site accommodates the engagement means of the minor component so as to form the incline configuration;

and the minor component is provided with engagement means in one site thereon, said site being located on the first wedge-forming face thereof.

It is currently preferred that the complementary engagement means provided on said first major component and said second minor component are in the form of male and female members. More preferably, said first major component is provided with female member(s) only, and said second minor component is provided with male member(s) only.

The wedge-subtending angle θ, is preferably in the range of from 20° to 35°, and more preferably, is substantially equal to 26°. Angle α is preferably in the range of from 10° to 25°, angle β is preferably in the range of from 0° to 25°, and still more preferably, α and β are substantially equal to one another, most preferably having a value substantially equal to 13°.

In the instance where the angles α and β are substantially equal to one another, the shape of the minor component, in overall outline in the shared normally-vertical plane of symmetry that accommodates the user's body-axis, will be that of a trapezium.

The major wedge-forming face and the major end-face of the major component, subtend an angle ϕ. This same angle, ϕ is also subtended by the second wedge-forming face and the major end-face of the minor component, and in the case where α=β, the angle subtended by the first wedge-forming face and the major end-face of the minor component is also equal to ϕ. The value of ϕ, and of all the other internal angles of the major and minor components, is dependent on the values of θ, α, and β, with the particular relationship between θ and ϕ being expressed by the formula $\theta=180-2\phi$, such that the value of ϕ is preferably in the range of from 65° to 80°, and more preferably is substantially equal to 77°.

The relative dimensions of the constituent faces of the major and minor components are also partly dependent on the value of E.

The length of the major wedge-forming face of the major component is preferably in the range of from 800 to 1300 mm, and more preferably is substantially equal to 1035 mm;

The length of the major end-face of the major component is preferably in the range of from 300 to 525 mm, and more preferably is substantially equal to 370 mm, such that when the major and minor components are assembled so as to form the bench configuration, the height of the major wedge-forming face of the major component above ground level is preferably in the range of from 300 to 500 mm, and more preferably is substantially equal to 360 mm;

The length of the minor wedge-forming face of the minor component is preferably in the range of from 550 to 900 mm, and more preferably is substantially equal to 715 mm;

The length of the fifth face of the major component is preferably in the range of from 235 to 385 mm, and more preferably is substantially equal to 305 mm; and The length of the minor end-face of the major component is preferably in the range of from 30 to 50 mm, and more preferably is substantially equal to 40 mm.

The length of the first wedge-forming face of the minor component is preferably in the range of from 280 to 495 mm, and more preferably is substantially equal to 370 mm;

The length of the second wedge-forming face of the minor component is preferably in the range of from 285 to 495 mm, and more preferably is substantially equal to 370 mm;

The length of the major end-face of the minor component is preferably in the range of from 255 to 410 mm, and more preferably is substantially equal to 330 mm;

The length of the minor end-face of the minor component is preferably in the range of from 125 to 205 mm, and more preferably is substantially equal to 160 mm; and The height of the minor end-face of the minor component above the major end-face thereof is preferably in the range of from 280 to 450 mm, and more preferably is substantially equal to 360 mm.

The width of the major and minor components normal to the plane of symmetry heretofore described is not essential to the operation of the present invention. Nevertheless, it is currently preferred that the widths of the major and minor components should be equal to one another, and preferably should be substantially equal to 350 mm. The presence of the side-pods at the vertex containing the cut-out section increases the external width of the major component to substantially 380 mm, with an internal separation between the side-pods of substantially 355 mm, so as to accommodate the minor component.

In the currently preferred embodiment, the male member(s) are in the form of (an) upstanding ridge(s) and the complementary female member(s) are in the form of groove(s), each extending substantially across the width of the respective component face. Preferably, said ridges and complementary grooves(s) will be of generally cylindrical or, more preferably "tear-drop" or "omega-shaped" cross-section, that is having the shape of the Greek letter Ω.

In a still further preferred embodiment, the set of male members comprises a pair of ridges, and the sets of female members located on the minor wedge-forming face and the fifth-face of the major component, comprise a pair of grooves. Above all it is preferred that said pair of ridges and said pairs of grooves comprise members of different size, so that the minor component may only enter into engagement with the major component, at said sites on the major component at which said pairs of grooves are located, in one specific intended orientation, thus forming the bench or chair configurations.

A third female member which is located within the cut-out section of the major component, comprises a single groove located in the internal face which intersects the major end-face, and is parallel to the fifth-face and major wedge-forming face. This groove co-operates with the complementary ridge member on the minor component located closest to the minor end-face thereof. Said groove is also preferably provided with small flexibly resilient lugs on its internal surface which serve to grip the ridge of the minor component, thus holding it in place when the apparatus is assembled in its incline configuration. Due to the presence of the side-pods, it is not possible for the complementary engagement means to mutually engage in a direction normal to the main plane of symmetry, as is the case for the formation of the bench and chair configurations. Instead, for the formation of the incline configuration, the ridge is pushed into the groove in a direction normal to the axis thereof, being held in position by the lugs in a so-called "snap-fit" kind of construction.

The minor component may also be additionally provided, with flexibly resilient lugs located above or below the ridges, at the edges of the first wedge-forming face. These lugs will co-operate with complementary apertures located in similar positions relative to the grooves on the major component. When the components are then assembled so as to form the active configurations, the lugs and complementary apertures will then co-operate in semi-locking engagement, and will "click" into place in order that the user may know when the components are correctly aligned with respect to one another.

The major component and/or the minor component may also be provided with channels shaped so as to receive elastic resistance bands therein during use of the apparatus.

Such elastic resistance bands are widely used in commercial and home gymnasiums, and it is envisaged that, in addition to the exercise apparatus according to the present invention being used with or without simple weights such as dumbbells, wrist-weights, and the like, these bands may also be used in combination therewith. The various positions of the channels shaped so as to receive the elastic resistance bands, will be determined by the particular exercise schedule associated with each configuration. The use of these elastic resistance bands in combination with the apparatus of the present invention, has the effect of turning the apparatus into an exercise "machine" rather than merely a platform on which exercises may be performed.

Hand-grips may also be provided on the major and/or minor component, serving to facilitate the performing of particular exercise schedules associated with each configuration, and their locations on the apparatus being determined accordingly. These hand-grips will preferably be in the form of cut-out sections, and more preferably be substantially crescent-shaped.

Whilst it is envisaged that the present invention may be constructed from any material which is robust enough to withstand the forces exerted on the apparatus during the exercises performed thereon, but yet being lightweight enough to be easily manipulated between the various configurations, it is currently preferred that the major and minor components are formed substantially from injection moulded plastics material. The internal structure of the major and minor components will preferably be defined by a plurality of cross-members, or a so-called "honeycomb" effect in order to impart structural strength to the components, and to distribute the forces exerted on the apparatus during use equally across the structure. The combined weight of the apparatus will be substantially less than known metal exercise benches, which typically weigh in the region of 20–25 kg, and will preferably be less than 12 kg.

The major and minor wedge-forming faces of the major component, and the minor end-face of the minor component are preferably provided with expanded-foam padding so as to provide exercise platforms thereon. Such padding may advantageously be formed as an integral part of the apparatus, in and by a secondary injection moulding process. This padding will provide extra comfort and safety for the user, due to its shock-absorbent properties, and will also provide an anti-slip effect when the apparatus is assembled in configurations where the padded exercise platforms come into contact with the ground.

It is desirable that the major and minor components are also provided with studs at the corners of the faces which are intended to come into contact with the floor in each of the configurations of the apparatus. These studs will preferably be formed of resilient rubber material, and serve both to protect the apparatus from damage, and to prevent slipping during use.

In a still further embodiment of the invention, the major wedge-forming face of the major component is in the form of a detachable platform; and there are further provided mounting blocks on which said detachable platform may be mounted, so as to form a so-called "step" aerobics exercise platform.

The detachable step platform will preferably be of equal length to the major wedge-forming face of the major component to which it attaches, and of equal width to said major component at its base, but with sloping sides such that the upper-face of said platform preferably has a width substantially equal to 215 mm, and the height of said upper-face above the base of said platform will preferably be substantially equal to 65 mm.

This modification is provided in order that the user may incorporate aerobic exercise into their fitness regime in addition to the anaerobic exercises already mentioned, thus offering a "total" fitness work-out. The use of so-called "step" platforms, is widely known and used in the field of aerobics, and is described, for example, in U.S. Pat. No. 5,620,404.

The detachable mounting will preferably be achieved by means of secondary engagement means similar to the primary engagement means described above with regard to the inter-engagement of the major and minor components. It is currently preferred that, these secondary engagement means comprise male member(s) in the form of ridges located substantially towards either end of the major wedge-forming face of the major component; and female member(s) in the form of grooves, located in complementary positions on the underside of the detachable "step" platform. These male and female members may also be of different sizes in order to ensure that the major component and the detachable platform are engageable only in one specific intended orientation.

In a further embodiment of the present invention, the major component may be further provided with a storage compartment therein, designed so as to accommodate items such as the elastic resistance bands, small weights, and other fitness accessories.

The present invention extends to encompass a kit of parts, whether assembled or not, comprising the major and minor components, and optionally, the detachable step platform and any associated accessories such as elastic resistance bands, dumb-bells, wrist-weights etc.

BRIEF DESCRIPTION OF THE DRAWINGS

In order that the present invention may be more fully understood, currently preferred embodiments will now be described in more detail, though only by way of example, with reference to the accompanying drawings, which are diagrammatic in order to illustrate certain features, and therefore not to an uniform scale, and in which.

DETAILED DESCRIPTION OF THE INVENTION

Figures 1, 2, 3:
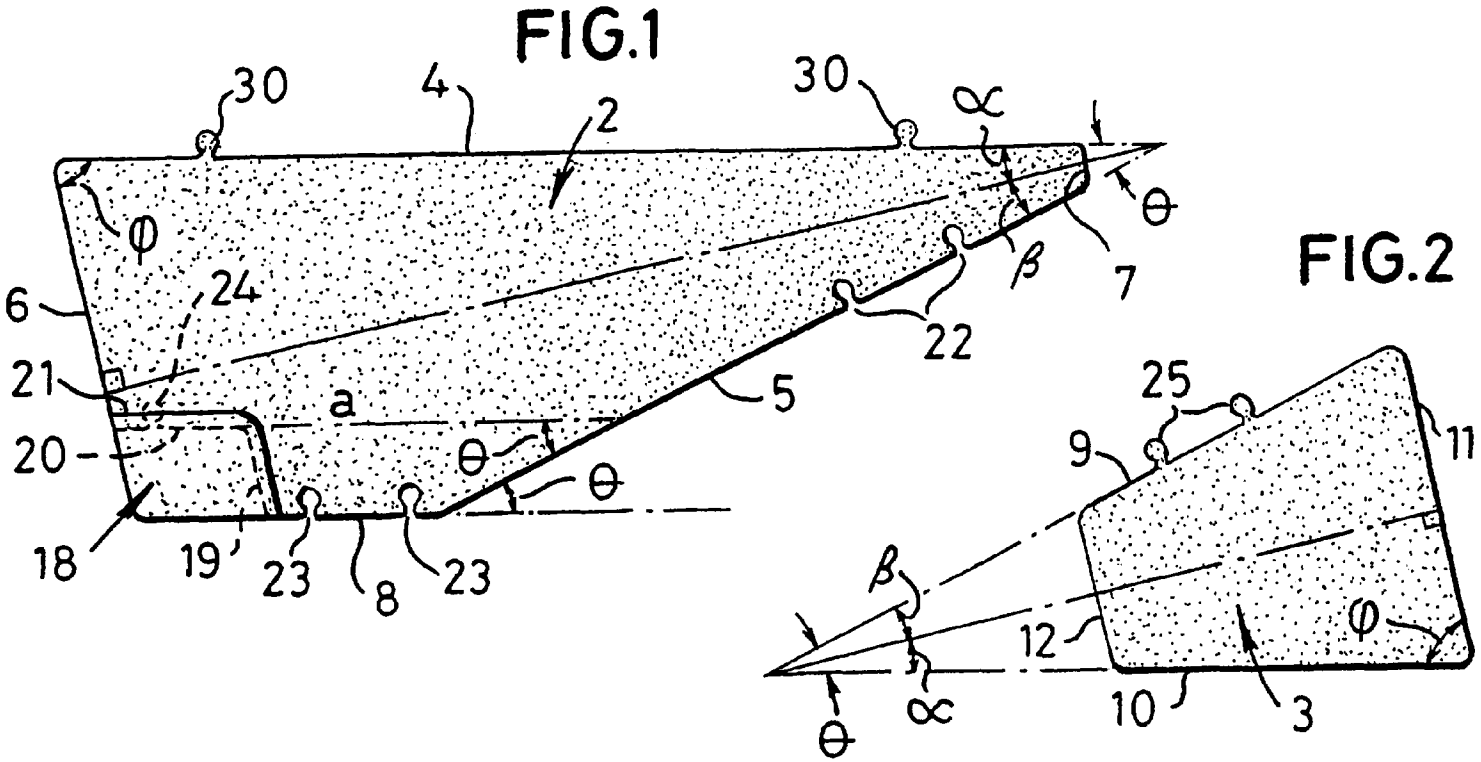
FIG. 1 is an essentially cross-sectional view (taken in the normally-vertical plane of symmetry that accommodates the user's body-axis) of the major component of the exercise apparatus.
FIG. 2 is a similar, essentially cross-sectional view (taken as before in the same, shared normally-vertical plane of symmetry that accommodates the user's body-axis) now of the minor component of the exercise apparatus.
FIG. 3 is a similar, essentially cross-sectional view (taken as before in the same shared normally-vertical plane of symmetry that accommodates the user's body-axis) this time of the detachable step platform.

Referring first to FIG. 1, it can be seen that the overall outline of the major component 2, in the normally-vertical plane of symmetry (which, when in use also accommodates the user's body axis) is a generally wedge-shaped irregular pentagon. This pentagon is defined by opposed non-parallel major and minor wedge-forming faces 4,5, which subtend an acute angle θ; also by two other opposed generally-parallel faces comprising a major end-face 6 and a minor end-face 7; and a fifth face 8, which intersects with the minor wedge-forming face 5 at one end thereof, and with the major end-face 6 at its other end.

The minor component 3, as shown in FIG. 2, has an overall outline (in the same normally-vertical plane of symmetry) which is a generally wedge-shaped tetragon, or preferably a trapezium. This tetragon is defined by two opposed non-parallel first and second wedge-forming faces 9,10, which also subtend an acute angle θ; and by two other opposed, generally-parallel faces comprising a major end-face 11 and a minor end-face 12.

Referring now to FIG. 3, this shows a detachable step platform 13, defined by top side 14, under-side 15, and first and second ends 16 and 17.

Figure 6:
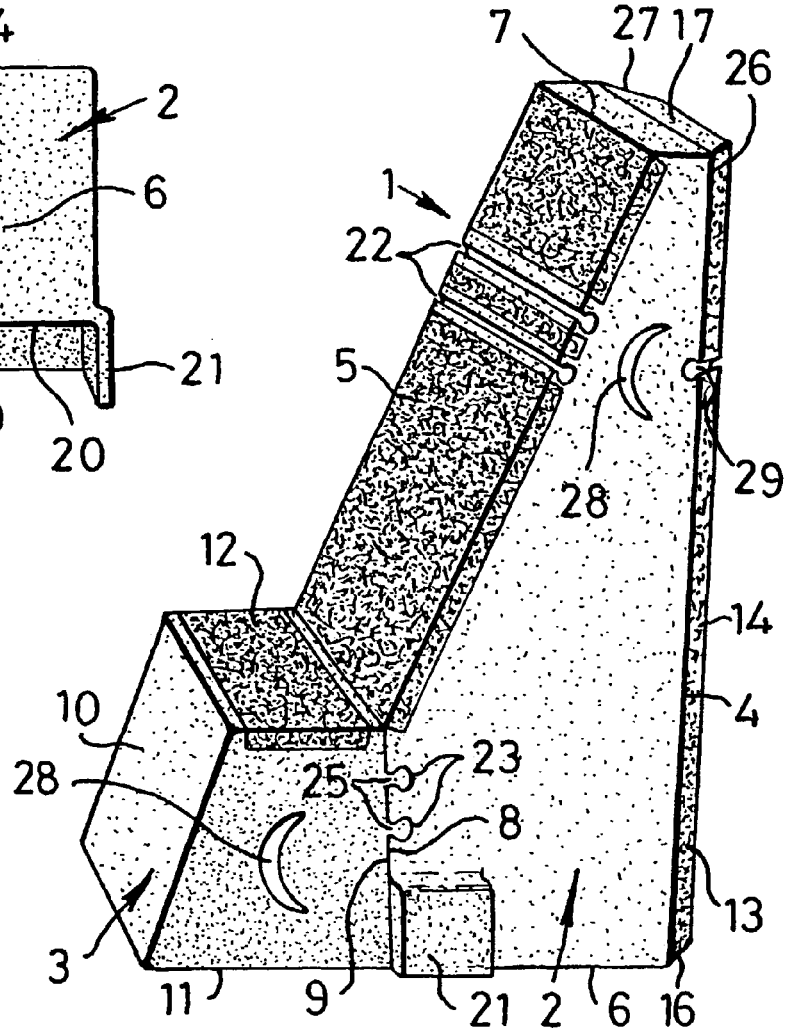
FIG. 6 is a perspective view of the same embodiment of the apparatus, when assembled in the chair configuration.
Figure 5:
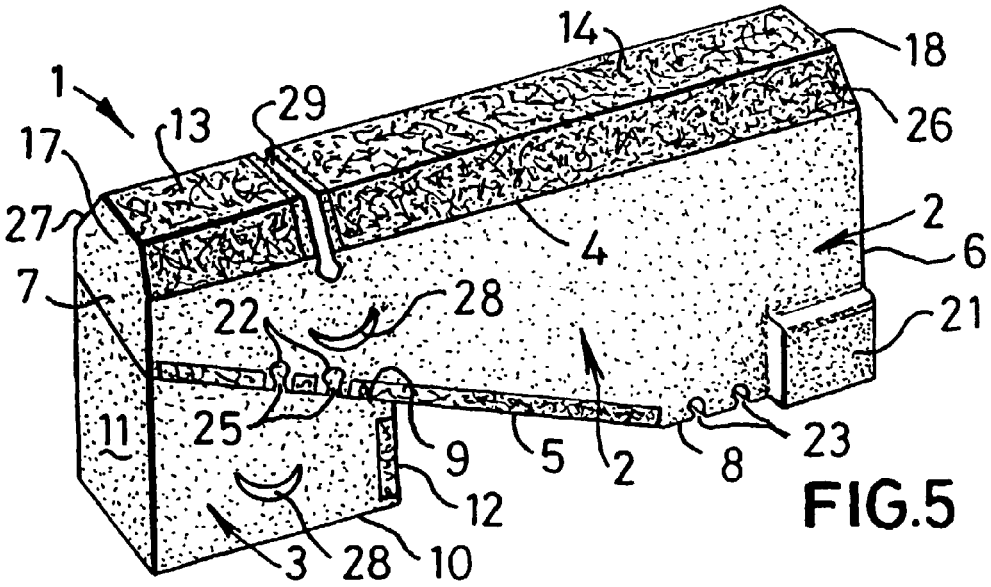
FIG. 5 is a perspective view of a currently preferred embodiment of the apparatus of FIGS. 1–4, when assembled in the bench configuration.
Figure 7:
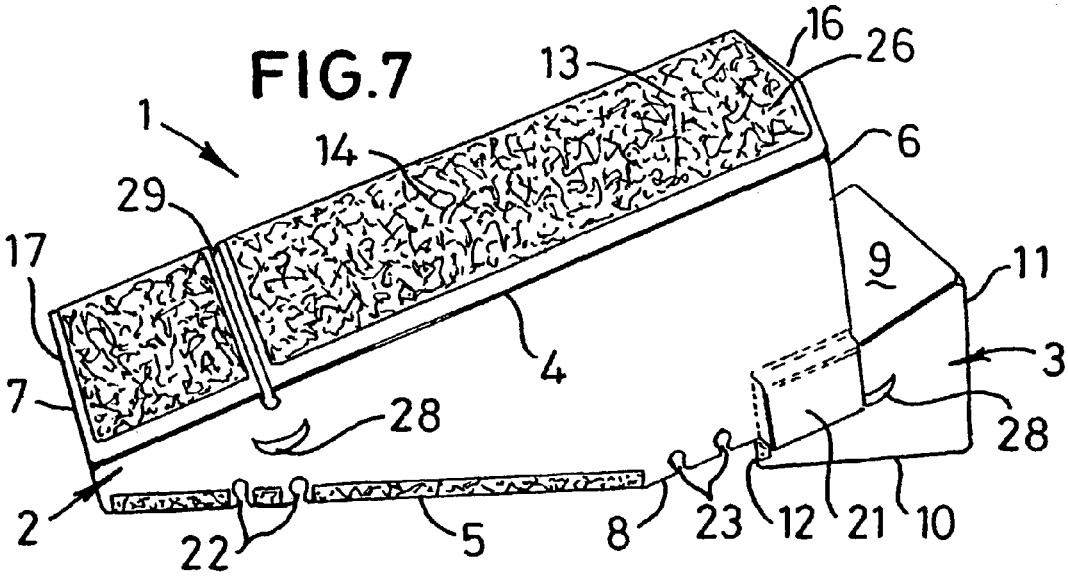
FIG. 7 is a perspective view of the same embodiment of the apparatus, when assembled in the incline configuration.

The major and minor wedge-forming faces 4 and 5 of the major component 2, and the minor end-face 12 of the minor component 3 form the exercise platforms of the apparatus 1 when assembled in its various possible configurations, as can be seen in FIGS. 5 to 7.

The major component 2 is further provided with a cut-out section, generally indicated 18, located within the corner between the major end-face 6 and the fifth face 8 of the pentagon. This cut-out section 18 comprises a first internal face 19 which intersects the fifth face 8 of the pentagon, and is parallel to the major end-face 6; and a second internal face 20 which intersects the major end-face 6 and is parallel with the major wedge-forming face 4 and the fifth face 8, such that the angle subtended by internal face 20 and the minor wedge-forming face 5 is also θ, as shown by dotted line a in FIG. 1.

Figure 4:
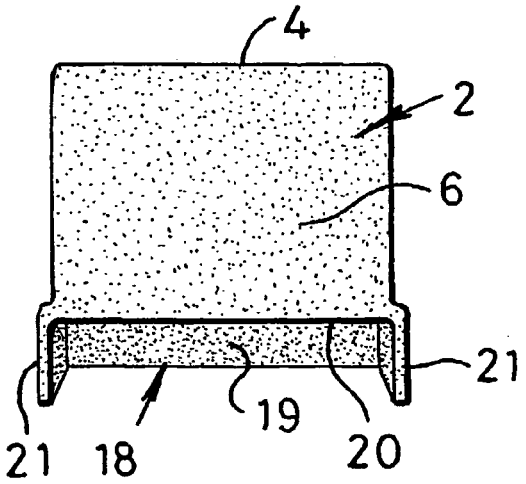
FIG. 4 is an end view of the major component of FIG. 1, in slight perspective so as to show the cut-away section contained within the vertex between the major end-face and the fifth face of the pentagonal major component.

As best shown in FIG. 4, the cut-out section 18 is provided on either side with side-pods 21. These side-pods 21 serve to stabilise the apparatus 1 when assembled in its bench and chair configurations, as shown in FIGS. 5 & 6 respectively, but allow the minor component 3 to gain access to the cut-out section 18 in order to assemble the apparatus 1 in the incline configuration, as shown in FIG. 7. The side pods 21 act as extensions to the fifth side 8 and the major end-face 6, but are displaced outwards from the pentagonal sides of the major component 2.

In this preferred embodiment of the invention, the major component 2 is provided with engagement means in the form of three sets of female members 22,23,24. The first set 22 is located in the minor wedge-forming face 5, disposed substantially towards the minor end 7 thereof; the second set 23 is located in the fifth face 8, in front of the side-pods 21; and the third set 24 is located within the second internal face 20 of the cut-out section 18. Each of these sets of female members 22,23,24 are engageable with complementary engagement means on the minor component 3, in the form of a set of male members 25 located on the first wedge-forming face 9 thereof. This set of male members 25 engages alternatively with each of the sets of female members 22,23,24, in order to assemble the apparatus 1 in, respectively, the bench, chair, and incline configurations, as shown in FIGS. 5 to 7.

The major component 2 is further provided on its major wedge-forming face 4 with secondary engagement means in the form of a set of male members 30 shaped so as to co-operate with complementary secondary engagement means in the form of a set of female members 31, located within the under-side 15 of the detachable step platform 13. The detachable step platform 13 can then be attached to the major wedge-forming face 4 of the major component 2 by means of the complementary secondary engagement means 30 and 31, in order that the top side 14 of said detachable step platform 13 forms the exercise platform when the apparatus 1 is assembled so as to form the bench and incline configurations.

Referring now to FIG. 5, this shows exercise apparatus, generally indicated 1, as assembled in the bench configuration. The major and minor components 2,3 are assembled in such a manner that the minor wedge-forming face 5 of the major component 2 is in abutting facial contact with the first wedge-forming face 9 of the minor component 3, and the assemblage is locked in position by the engagement of male members 25 with the first set of female members 22. The minor end-face 7 of the major component 2 is co-planar with the major end-face 11 of the minor component 3. The second wedge-forming face 10 of the minor component 3 is co-planar with the fifth face 8 of the major component 2, and both of these rest on the ground. The detachable step platform 13 is attached to the major wedge-forming face 4 of the major component 2, and its top side 14 is disposed horizontally so as to form the exercise platform, which will preferably be padded, and may desirably be shaped so as to have sloping edges 26,27.

Referring now to FIG. 6, this shows the exercise apparatus, generally indicated 1, when assembled in the chair configuration. This configuration is formed by placing the major and minor components 2,3 so that their respective major end-faces 6,11 are side-by-side, co-planar, and resting on the ground. The fifth face 8 of the major component 2 is in abutting facial contact with the first wedge-forming face 9 of the minor component, and the assemblage is locked in position by the engagement of the set of male members 25 with the second set of female members 23. The minor end-face 7 of the major component 2 and the minor end-face 12 of the minor component 3 are both horizontal, and the minor end-face 12 of the minor component 3 forms the seat portion of the chair, which preferably will be padded. The minor wedge-forming face 5 of the major component 2 forms the back-support portion of the chair, which preferably will also be padded, and reclines from the vertical at an angle equal to β, which is also the angle at which the second wedge-forming face 10 of the minor component 3 reclines from the vertical.

Referring now to FIG. 7, this shows the exercise apparatus, generally indicated 1, when assembled in the incline configuration. The minor wedge-forming face 5 of the major component 2 rests on the ground, as does the second wedge-forming face 10 of the minor component 3. The minor component 3 is inserted into the cut-out section 18 so that the minor end-face 12 of the minor component 3 is in abutting facial contact with the first internal face 19 of the major component 2, and the first wedge-forming face 9 of the minor component 3 is in abutting facial contact with the second internal face 20 of the major component 2. The assemblage in this configuration is locked in position by the engagement of the set of male members 25 with the third set of female members 24. The detachable step platform 13 is attached to the major wedge-forming face 4 of the major component 2 so that its top side 14 then forms the exercise platform, which will preferably be padded, and is inclined at an angle P from the horizontal.

The major and minor components 2,3 may also preferably be provided with hand-grips 28 in the form of cut-out crescents, and channels 29 shaped so as to accommodate the use of elastic resistance bands (not shown). The locations of these hand-grips 28 and channels 29 will be determined according to the particular exercise schedules associated with the apparatus.

Figure 8:
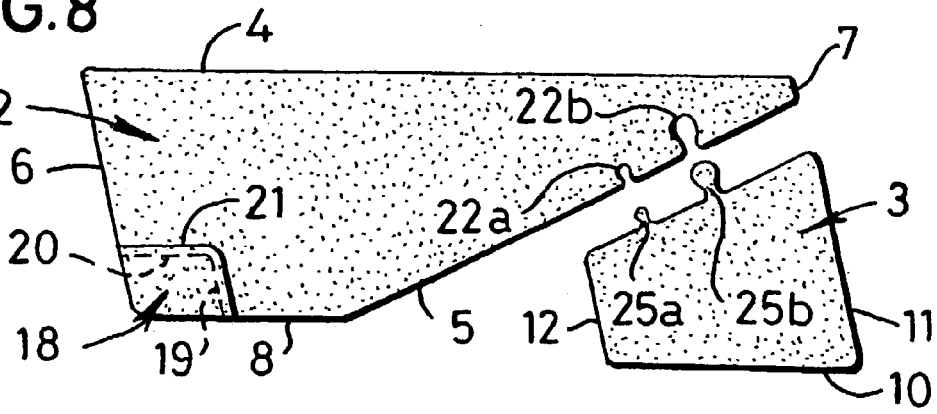
FIG. 8 is an exploded, diagrammatic view (not to a consistent scale) showing in more detail a preferred construction of the complementary engagement means between the major and minor components when assembled in the bench configuration.

In order that the major component 2 and the minor component 3 may only be engaged in one specific orientation at each engagement site, it is currently preferred that the sets of male and female members should comprise members of substantially different sizes, as shown in exaggerated detail in FIG. 8. It will be seen that the set of male members 25 on the minor component 3 comprises a smaller member 25*a* and a larger member 25*b*. Likewise, the set of complementary female members 22 on the major component 2, with which the male members 25*a*, 25*b* on the minor component 3 may engage, comprises a smaller member 22*a* and a larger member 22*b*.

It will be appreciated that the smaller male member 25*a* may only engage with the smaller female member 22*a*, and not with the larger female member 22*b*; whilst the larger male member 25*b* may only engage with the larger female member 22*b*, and not with the smaller female member 22*a*. Whilst this preferred construction of engagement means is only shown here with reference to the engagement of the set of male members 25 with the first set of female members 22, it will be appreciated that this preferred construction also extends to the engagement of the set of male members 25 with the second set of female members 23, and to the engagement of the secondary male and female members 30, 31 which enable the attachment of the detachable step platform 13 to the major component 2. Additionally, although it is shown here that 25*b* is greater in size than 25*a*, and that 22*b* is greater in size than 22*a*, these relative proportions may of course be reversed.

Figure 9:
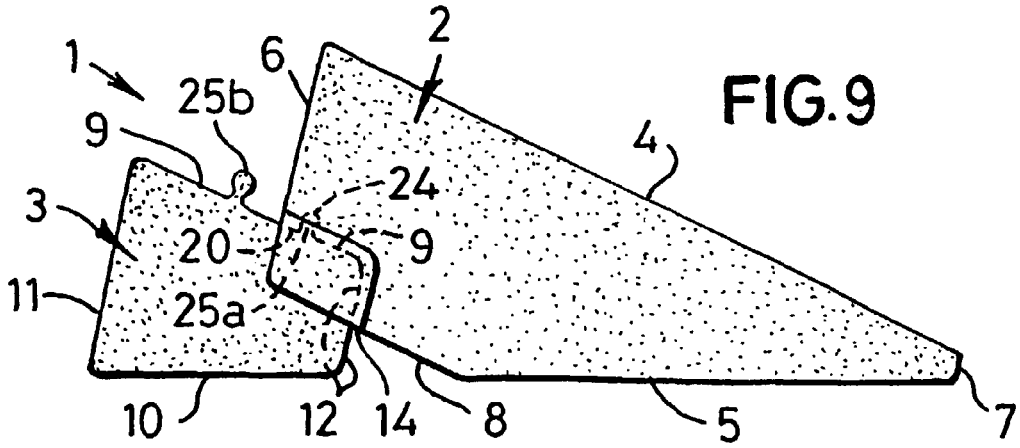
FIG. 9 is a similar, exploded, diagrammatic view showing a preferred construction of the engagement means between the major and minor components when assembled in the incline configuration.

It is currently preferred that the third set of female members 24, which is located within the second internal face 20, should comprise only one groove, shaped so as to receive the male member 25*a* on the minor component 3 which is closest to the minor end-face 12 thereof, as is best shown in FIG. 9. The male member 25*a* is arranged to engage with the female member 24 by a 'snap-fit' mechanism. This is unlike the engagement of the male members 25 with the other two sets of female members 22, 23 (in order to form the bench and chair configurations) which is achieved by sliding the ridges of the male members 25 into the grooves of the female members 22, 23 from a direction normal to the shared plane of symmetry of the major and minor components. It will be noted that when assembling the apparatus 1 in the incline configuration, the second male member 25*b* is not used in the inter-engagement of the major and minor components 2, 3.

The invention claimed is:

1. Exercise apparatus in the form of a kit of parts, whether assembled or not, which comprises at least a first major component provided with engagement means in at least three alternative sites thereon, and a second minor component provided at a site thereon with engagement means complementary to those on the major component, said engagement means being detachably interengageable with one another in alternative mutual orientations of the components wherein:

the major and minor components are each substantially symmetrical about a shared, normally-vertical plane of symmetry, which in use also accommodates the user's body axis:

in overall outline in said shared normally-vertical plane of symmetry that accommodates the user's body axis, the major and minor component are each generally wedge-shaped, the opposed, wedge-forming sides thereof subtending the same angle θ in each component; and said complementary engagement means provided on said first major component and said second minor component are in the form of male and female members;

such that in use, the resultant assemblage can be arranged and rearranged at will to assume each of a range of alternative configurations comprising bench, chair and incline configurations.

2. Exercise apparatus as claimed in claim 1, in which the complementary engagement means on both the major component and the minor component are disposed and are mutually engageable and disengageable normal to said plane of symmetry in order to assume at least said bench and chair configuration.

3. Exercise apparatus as claimed in claim 1, in which in overall outline in the shared normally-vertical plane of symmetry that accommodates the user's body-axis, the major component is a generally wedge-shaped irregular pentagon, having major and minor wedge-forming sides, and the minor component is a generally wedge-shaped irregular tetragon each of said components having two opposed non-parallel faces subtending the same angle θ in each component and each having two other opposed generally-parallel faces, the pentagon having a fifth face intersecting with the minor wedge-forming face at one end thereof and with the major end-face at its other end, and being parallel to the major wedge-forming face, so that when assembled with the major end-faces of both components side-by-side in the same horizontal plane and with one of the wedge-forming faces of the tetragon in abutting facial contact with the fifth face of the pentagon then the assemblage is arranged so as to assume its chair configuration with the minor end face of the tetragon in an horizontal plane to serve as seat-portion of said chair and the minor wedge-forming face of the pentagon reclines therefrom to serve as back-portion of said chair.

4. Exercise apparatus as claimed in claim 3, in which the acute angle subtended by the wedge-forming opposed non-parallel faces of both the major and the minor components is θ; the acute angle α between the major wedge-forming face of the manor component and a perpendicular from the major end-face thereof is equal to the acute angle α between the first wedge-forming face of the minor component and a perpendicular from the major end-face thereof; the acute angle β between the minor wedge-forming face of the major component and a perpendicular from the major end-face thereof is equal to the acute angle β between the second wedge-forming face of the minor component and a perpendicular from the major end-face thereof; and in which $\alpha+\beta=\theta$; while the back-portion of said chair reclines at an acute angle from the vertical, which is equal to β.

5. Exercise apparatus as claimed in claim 3, in which the major component is further provided with a cut-out section in the corner thereof between its major end-face and the fifth face thereof, which cut-out section comprises an internal face intersecting the fifth face being parallel to the major end-face of the major component, and an internal face intersecting said major end-face being parallel with the major wedge-forming face of said major component; the dimensions of the cut-out being complementary with those of the minor component, such that when the minor end of the minor component is mated therewith, one of its wedge-forming faces is co-planar with the minor wedge-forming face of the major component, so that when thus assembled the resultant assemblage assumes its incline configuration.

6. Exercise apparatus as claimed in claim 5, in which the major component is provided with side-pods to either side of the cut-out section, said side-pods comprising a side parallel to and co-planar with the fifth face of the pentagon, and a side parallel to and co-planar with the major end-face of the major component, said side-pods being displaced outwards from the plane of the pentagon so as to constitute extensions of the fifth side thereof and the major end-face, but allowing access to the complementary internal faces within said cut-out.

7. Exercise apparatus as claimed in claim 5, in which the at least three sites on the major component at which there are provided engagement means comprise:

a site located in the minor wedge-forming face, disposed substantially towards the minor end thereof, which site accommodates the engagement means of the minor component so as to form the bench configuration;

a site located in the fifth face of the pentagon, which site accommodates the engagement means of the minor component so as to form the chair configuration; and a site located within the cut-out section, in the internal face intersecting the major end-face, being parallel with the major wedge-forming face, which site accommodates the engagement means of the minor component so as to form the incline configuration.

8. Exercise apparatus as claimed in claim 1, in which said first major component is provided with female members only and said second minor component is provided with male member(s) only.

9. Exercise apparatus as claimed in claim 1, in which the wedge-subtending angle θ is in the range of from 20° to 35°.

10. Exercise apparatus as claimed in claim 9, in which the wedge-subtending angle θ is substantially equal to 26°.

11. Exercise apparatus as claimed in claim 4 in which the angles α and β are substantially equal.

12. Exercise apparatus as claimed in claim 1, in which the male member(s) are in the form of (an) upstanding ridge(s) and the complementary female member(s) are in the form of groove(s), each extending substantially across the width of the respective component face.

13. Exercise apparatus as claimed in claim 12, in which the male member(s) and the complementary female member(s) are of generally cylindrical, polygonal or omega-shaped cross-section.

14. Exercise apparatus as claimed in claim 12, in which the set of male members comprises a pair of ridges and the first and second sets of female members each comprise a pair of grooves.

15. An exercise apparatus as claimed in claim 14, in which each pair of ridges and each pair of grooves comprises members of different size, so that the minor component may only enter into engagement with the major component in one specific orientation at each site on the major component at which the female members are located.

16. Exercise apparatus as claimed in claim 1 in which the major component and/or the minor component are provided with channels adapted to receive elastic resistance bands therein.

17. Exercise apparatus as claimed in claim 1, in which the major component and/or the minor component are provided with cut-out sections therein to act as hand-grips during use of the apparatus.

18. Exercise apparatus as claimed in claim 1, in which the major and minor components are formed substantially from injection moulded plastics material.

19. Exercise apparatus as claimed in claim 3, in which the major wedge-forming face of the major component is in the form of a detachable platform; and there are further provided mounting blocks on which said detachable platform may be mounted, so as to form a so-called 'step' aerobics exercise platform.

* * * * *